US009403258B2

(12) United States Patent
Moudry et al.

(10) Patent No.: US 9,403,258 B2
(45) Date of Patent: Aug. 2, 2016

(54) METHOD FOR FORMING AN ABRASIVE LAPPING PLATE

(71) Applicant: Seagate Technology LLC, Cupertino, CA (US)

(72) Inventors: Raymond Leroy Moudry, Bloomington, MN (US); Mihaela Ruxandra Baurceanu, Edina, MN (US); Joel William Hoehn, Hudson, WI (US)

(73) Assignee: SEAGATE TECHNOLOGY LLC, Cupertino, CA (US)

( * ) Notice: Subject to any disclaimer, the term of this patent is extended or adjusted under 35 U.S.C. 154(b) by 309 days.

(21) Appl. No.: 13/929,436

(22) Filed: Jun. 27, 2013

(65) Prior Publication Data

US 2015/0000202 A1 Jan. 1, 2015

(51) Int. Cl.
*B24D 11/00* (2006.01)
*B24B 37/12* (2012.01)

(52) U.S. Cl.
CPC ..... *B24B 37/12* (2013.01)

(58) Field of Classification Search
CPC ..... B24D 11/00
See application file for complete search history.

(56) References Cited

U.S. PATENT DOCUMENTS 3,864,101 A * 2/1975 Charvat ..... 51/298
4,037,367 A 7/1977 Kruse
5,199,227 A * 4/1993 Ohishi ..... 451/527
5,219,462 A * 6/1993 Bruxvoort ..... B24D 3/002 51/293
5,256,170 A * 10/1993 Harmer ..... B24D 3/28 428/323
5,318,604 A 6/1994 Gorsuch et al.
5,411,810 A * 5/1995 Hirakouchi et al. ..... 428/480
6,551,366 B1 * 4/2003 D'Souza ..... C09K 3/1436 51/295
7,235,296 B2 6/2007 Hunt et al.
7,410,410 B2 8/2008 Mahadev et al.
7,594,845 B2 9/2009 Lugg et al.
7,887,607 B2 2/2011 Kim
2003/0148106 A1 * 8/2003 Ma et al. ..... 428/411.1
2011/0092137 A1 * 4/2011 Ohishi et al. ..... 451/28
2012/0009856 A1 1/2012 Moudry et al.

OTHER PUBLICATIONS

3M™ Diamond Resin Bond Abrasives, printed from www.3m.com, May 7, 2013.
U.S. Appl. No. 13/716,456, filed Dec. 17, 2012, Moudry et al.

* cited by examiner

*Primary Examiner* — Pegah Parvini
(74) *Attorney, Agent, or Firm* — HolzerIPLaw, PC

(57) ABSTRACT

A method of forming a lapping plate. The method includes providing a lapping plate having a surface, spraying an adhesive onto the surface, spraying a slurry of abrasive particles and solvent onto the adhesive, and curing the adhesive to form an abrasive coating on the lapping plate. The adhesive may be, for example, epoxy, and the abrasive particles may be, for example, diamonds.

19 Claims, 2 Drawing Sheets

METHOD FOR FORMING AN ABRASIVE LAPPING PLATE

BACKGROUND

Hard disc drive systems (HDDs) typically include one or more data storage discs. A magnetic head carried by a slider is used to read from and write to a data track on a disc. In order to achieve maximum efficiency from the magnetic head, the sensing elements must have precision dimensional relationships to each other as well as the application of the slider air bearing surface to the magnetic recording disc. During manufacturing, it is most critical to grind or lap these elements to very close tolerances of desired thickness in order to achieve the unimpaired functionality required of sliders.

Conventional lapping processes utilize either oscillatory or rotary motion of the workpiece across either a rotating or oscillating lapping plate to provide a random motion of the workpiece over the lapping plate and randomize plate imperfections across the head surface in the course of lapping.

Rotating lapping plates, having a horizontal lapping surface in which abrasive particles such as diamond fragments are embedded, have been used for lapping and polishing purposes in the high precision lapping of magnetic transducing heads. In some of these lapping processes, an abrasive slurry utilizing a liquid carrier containing diamond fragments or other abrasive particles is applied to the lapping surface as the lapping plate is rotated relative to the slider or sliders maintained against the lapping surface. Common practice is to periodically refurbish the lapping plate with a lapping abrasive to produce a surface texture suitable for the embedding and retention of the appropriate size of diamond abrasive being used with the lapping process. In other processes, the abrasive particles are embedded into the surface of the lapping plate, in some embodiments with a polymeric resin, resulting in a "fixed" abrasive surface.

SUMMARY

One particular embodiment of this disclosure is a method for forming a lapping plate. The method includes providing a lapping plate having a surface, spraying an adhesive onto the surface, spraying a slurry of abrasive particles and solvent onto the adhesive, and curing the adhesive to form an abrasive coating on the lapping plate.

Another particular embodiment of this disclosure is a method of forming a lapping plate, this method comprising providing a lapping plate having a surface, spraying a first part of an epoxy resin onto the surface, spraying a second part of the epoxy resin onto the surface, spraying a slurry of abrasive particles and solvent onto the surface, and after spraying the first part, the second part and the slurry onto the surface, reacting the first part and the second part to form an abrasive coating on the lapping plate.

Yet another particular embodiment of this disclosure is a method of forming a lapping plate, this method comprising providing a lapping plate having a surface, spraying an adhesive onto the surface with a first applicator, spraying a slurry of abrasive particles and solvent onto the surface with a second applicator, and after spraying the adhesive and the slurry onto the surface, reacting the adhesive to form an abrasive coating on the lapping plate.

These and various other features and advantages will be apparent from a reading of the following detailed description.

BRIEF DESCRIPTION OF THE DRAWING

The disclosure may be more completely understood in consideration of the following detailed description of various embodiments of the disclosure in connection with the accompanying drawing, in which.

DETAILED DESCRIPTION

Figure 1:
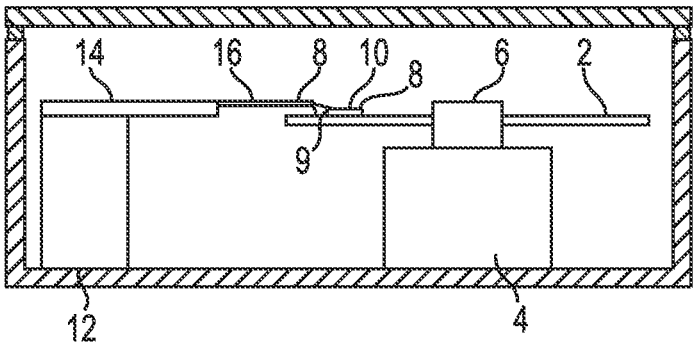
FIG. 1 is a sectional side view of a magnetic recording disc drive.

The present embodiments relate most generally to the manufacture of abrading tools, particularly lapping plates or platens. For purposes of this description, although not so limited, reference is made to the use of an abrading tool in high precision lapping of sliders and the supported magnetic transducing heads used in data storage devices. The sliders and particularly the heads, operably used to store and retrieve data on rotatable magnetic recording discs, require extremely precise manufacturing tolerances. The present disclosure provides a method of forming a precise abrasive surface on the lapping plate or platen used to produce the sliders and heads.

Lapping processes utilize either oscillatory or rotary motion of a slider bar across a rotating lapping plate to provide a random motion of the slider bar over the lapping plate and randomize plate imperfections across the head surface in the course of lapping. Some lapping plates have an abrasiveless horizontal working surface and are used in conjunction with a slurry of abrasive particles (e.g., diamonds), whereas other lapping plates have abrasive particles (e.g., diamonds) embedded in or on the horizontal working surface. The working surface may be a continuous surface having a constant level, or the surface may have random or patterned interruptions in the lapping surface, for example, concentric, radial, or spiral grooves. The interrupted surface reduces hydroplaning of the slider bar on the working surface and facilitates the removal of liquid and debris (swarf) beyond the lap plate peripheral.

In the following description, reference is made to the accompanying drawing that forms a part hereof and in which are shown by way of illustration at least one specific embodiment. The following description provides additional specific embodiments. It is to be understood that other embodiments are contemplated and may be made without departing from the scope or spirit of the present disclosure. The following detailed description, therefore, is not to be taken in a limiting sense. While the present disclosure is not so limited, an appreciation of various aspects of the disclosure will be gained through a discussion of the examples provided below.

Unless otherwise indicated, all numbers expressing feature sizes, amounts, and physical properties are to be understood as being modified by the term "about." Accordingly, unless indicated to the contrary, the numerical parameters set forth are approximations that can vary depending upon the desired properties sought to be obtained by those skilled in the art utilizing the teachings disclosed herein.

As used herein, the singular forms "a", "an", and "the" encompass embodiments having plural referents, unless the content clearly dictates otherwise. As used in this specification and the appended claims, the term "or" is generally employed in its sense including "and/or" unless the content clearly dictates otherwise.

Spatially related terms, including but not limited to, "lower", "upper", "beneath", "below", "above", "on top", etc., if used herein, are utilized for ease of description to describe spatial relationships of an element(s) to another. Such spatially related terms encompass different orientations of the device in addition to the particular orientations depicted in the figures and described herein. For example, if a structure depicted in the figures is turned over or flipped over, portions previously described as below or beneath other elements would then be above those other elements.

Figure 2:
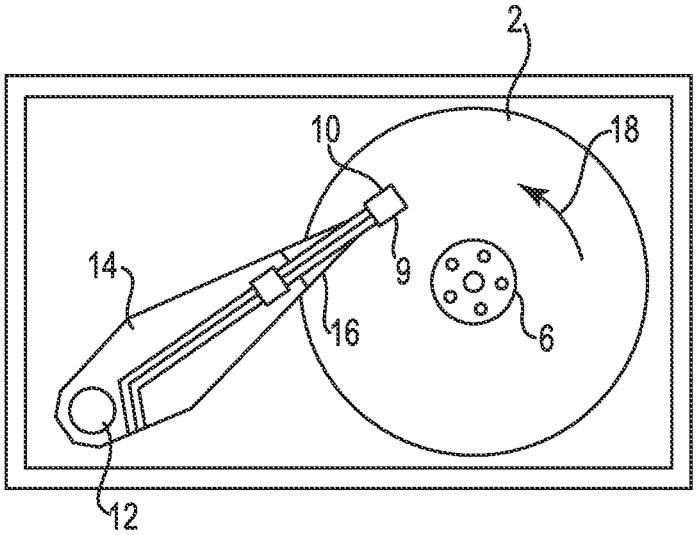
FIG. 2 is a top view of the magnetic recording disc drive of FIG. 1.

Referring to FIGS. 1 and 2, a generic magnetic recording disc drive is illustrated, having a magnetic recording disc 2 which is rotated by drive motor 4 with hub 6 which is attached to the drive motor 4. A read/write head or transducer 8 is present on the trailing end or surface 9 of a slider 10. Slider 10 is connected to an actuator 12 by means of a rigid arm 14 and a suspension element 16. Suspension element 16 provides a bias force that urges slider 10 toward the surface of disc 2. During operation of the disc drive, drive motor 4 rotates disc 2 at a constant speed in the direction of arrow 18 and actuator 12, which is typically a linear or rotary motion coil motor, drives slider 10 generally radially across the plane of the surface of disc 2 so that read/write head 8 may access different data tracks on disc 2.

In order to meet the ever-increasing demands for more and more data storage capacity on disc 2, slider fabrication and finishing must continue to improve. To meet these demands, lapping and polishing methodology must be developed which enhance slider features. Typically, numerous sliders are fabricated from a single wafer having rows of magnetic transducer heads deposited simultaneously on the wafer surface using semiconductor-type process methods. In some processes, single-row bars are sliced from the wafer, each bar being a row of units that are processed into sliders each having one or more magnetic transducers or heads on their end faces. Each row bar is bonded to a fixture or tool for further processing (e.g., lapping) and then further diced i.e., separated into individual sliders. In other processes, stacks or chunks are sliced from the wafer, each stack having multiple rows of units that are eventually processed into sliders. Each stack is bonded to a fixture or tool for lapping and eventually separated into individual sliders. In still other processes, individual sliders are lapped.

In order to achieve maximum efficiency of the slider during use in the reading/recording operation of the disc drive, the head, particularly the sensing elements of the head, must have precise dimensions. The present disclosure provides a lapping plate that provides the needed close tolerances while maintaining long plate life. The lapping plate is formed by applying a coating of polymeric adhesive and abrasive particles to the surface of the lapping plate to form an abrasive working surface.

Figure 3:
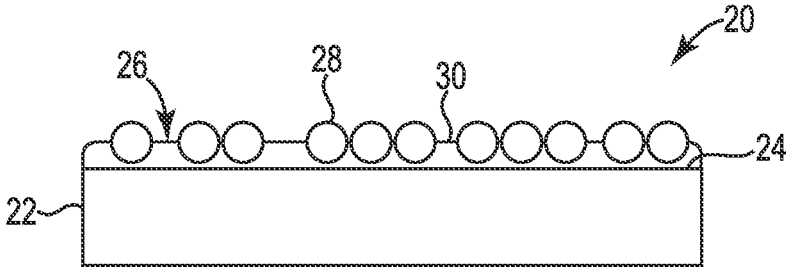
FIG. 3 is a schematic side view of a lapping plate according to this disclosure.

FIG. 3 diagrammatically depicts an enlarged view of a lapping plate (also often referred to as a platen) used for machining a slider bar, the plate having been made in accordance with the present disclosure. Lapping plate 20 has a body 22 with a platen surface 24 on which an abrasive coating 26 is present. Abrasive coating 26 has a plurality of abrasive particles 28 bonded to platen surface 24 by a polymeric adhesive 30.

Figure 4:
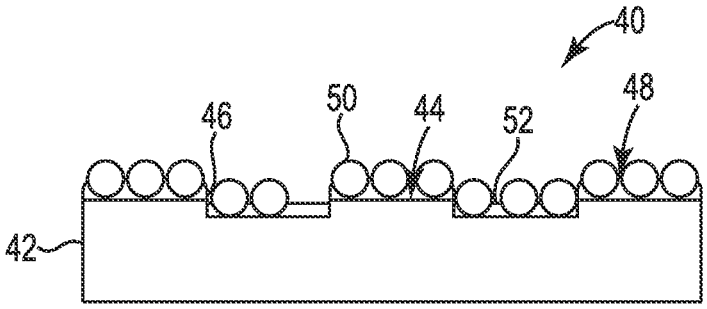
FIG. 4 is a schematic side view of another lapping plate according to this disclosure.

FIG. 4 diagrammatically depicts an enlarged view of another embodiment of a lapping plate having been made in accordance with the present disclosure. Lapping plate 40 has a body 42 with a platen surface 44, the surface having a plurality of grooves, indents or recessed regions 46. Recessed regions 46 may be made by known methods, including skiving, cutting, and knurling. An abrasive coating 48 is present over the entire platen surface 44, including within recessed regions 46. In alternate embodiments, abrasive coating 48 may be present in only recessed regions 46 or only on platen surface 44 not having recessed regions 46. Abrasive coating 48 has a plurality of abrasive particles 50 bonded to platen surface 44 by a polymeric adhesive 52.

Body 22, 42 may be formed of any suitable material such as metal, ceramic, polymeric material, and combinations thereof. Body 22, 42 may be a single material or may be formed from layers; in some embodiments, body 22, 42 includes a different top layer (e.g., a softer material, such as tin alloy) that forms platen surface 24, 44.

In use, lapping plate 20, 40 is rotated relative to the slider bar (cut from a wafer) containing a plurality of sliders, the bar held in pressing engagement against abrasive coating 26, 48. The abrading action due to abrasive particles 28, 50 at the working surface removes material from the slider bar and provides the desired shape to the slider bar.

For most lapping processes, the process includes three sequential steps: a rough lapping step, a fine lapping step, and a kiss lapping step. For a rough lapping step, the abrasive particles (e.g., diamonds) are usually about 1 to about 5 micrometers in size, in some embodiments as large as 10 micrometers; for a fine lapping step, the abrasive particles are usually about 0.1 to about 1 micrometer in size; for a kiss lapping step, the abrasive particles are usually less than 0.1 micrometer (100 nm). The abrasive lapping plates made by the methods of this disclosure have an advantage over other lapping plates used for processing sliders, as these methods allow smaller abrasive particles to be used, while obtaining the same stock removal rate, often with a smoother surface finish.

Although diamond is the preferred abrasive particle for the lapping process, other abrasive particles such as cubic boron nitride (CBN), alumina or aluminum oxide, alumina zirconia, ceria or cerium oxide, garnet, sapphire, silicon carbide, etc., could be used. Composite abrasive particles or agglomerates, which are composed of abrasive particles held together with a matrix (e.g., a ceramic, glass, metal or polymeric matrix) can be used; the composite abrasive particles may have an irregular shape or have a precise, molded shape. The diamond particles may be natural diamonds or manufactured, polycrystalline or single crystal, they may be crushed and screened to size, and they may be either block or sharp.

Polymeric adhesive 30, 52 holds abrasive particles 28, 50 onto platen surface 24, 44. Polymeric adhesive 30, 52 preferably includes a thermosetting resin such as epoxy resin, phenolic or phenol resin, melamine resin, urea resin, urea-melamine copolymerized resin, urethane resin, or polyester resin. The resin may be, for example, thermal cured, cured via UV radiation, IR cured, or moisture cured. Epoxy is a preferred adhesive 30, 52 for the methods and resulting lapping plates of this disclosure. Epoxies are from a class of reactive prepolymers and polymers that contain epoxide groups. Epoxy resins may be reacted (i.e., cross-linked) either with themselves through catalytic homopolymerisation, or with a wide range of co-reactants including polyfunctional amines, acids (and acid anhydrides), phenols, alcohols, and thiols. These co-reactants are often referred to as 'hardeners' and the cross-linking reaction is commonly referred to as 'curing'. Epoxy, in general, is readily available, is fairly inexpensive, is easy to apply, and results in a robust, high hardness coating. The cured epoxy is non-water soluble and non-soluble in the solvents used during the lapping process.

The desired polymeric adhesive 30, 52 or components of the adhesive (such the two components of an epoxy), prior to curing, have a sufficiently low viscosity to allow the adhesive to be sprayed onto platen surface 24, 44. In some embodiments, the viscosity is no more than about 50 cps, and in other embodiments is about 20-40 cps. Polymeric adhesive 30, 52 may be diluted with solvent to obtain an acceptable viscosity and facilitate spraying.

Abrasive coating 26, 48 may include any optional additives such as fillers, lubricants, surfactants, dyes, etc. These additives may be added to polymeric adhesive 30, 52, to abrasive particles 28, 50, or applied separately to platen surface 24, 44.

To form lapping plates 20, 40 having the abrasive working surface, abrasive coating 26, 48 is applied by spraying polymeric adhesive 30, 52 and abrasive particles 28, 50 onto platen surface 24, 44. Abrasive particles 28, 50, in the form of a liquid slurry, are sprayed onto platen surface 24, 44 separately from adhesive 30, 52, in most embodiments after at least a portion of adhesive 30, 52 has been sprayed onto platen surface 24, 44. Typically, the resulting abrasive coating 26, 48 covers the entire platen surface 24, 44 with a consistent thickness of coating 26, 48, although in some embodiments abrasive coating 26, 48 may be patterned, such as with a mask, to provide areas of platen surface 24, 44 void of abrasive coating 26, 48. Depending on the coating weight of adhesive 30, 52 and/or of abrasive particles 28, 50, in some embodiments a discontinuous coating (e.g., with pin holes) may be formed.

Figure 5:
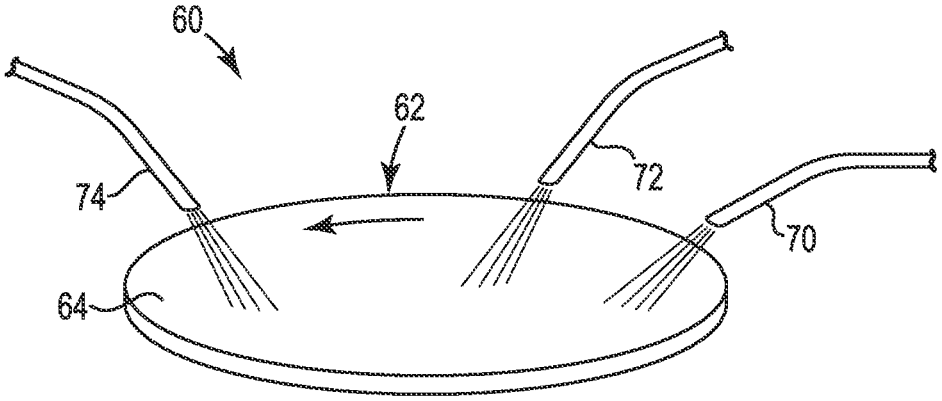
FIG. 5 is a schematic perspective view of a system for forming a lapping plate according to this disclosure.

FIG. 5 shows a rough diagram of a system 60 for coating lapping plate 62 (having a top surface 64) with an abrasive coating. System 60 includes at least one spray applicator or spray nozzle for applying polymeric adhesive 30, 52 and a spray applicator or nozzle for applying a slurry of abrasive particles 28, 50 onto surface 64. The system includes a mechanism for rotating plate 62. In the illustrated embodiment, system 60 includes a first adhesive spray applicator or nozzle 70 and a second adhesive spray applicator or nozzle 72. Other systems may have one spray applicator or nozzle, depending on the adhesive being applied. In some embodiments, the same spray applicator or nozzle could be used for two adhesive components. Also included in system 60 is an abrasive spray applicator or nozzle 74. Nozzles 70, 72, 74 are appropriately connected to supply lines, holding tanks, etc. of the material being applied by each nozzle 70, 72, 74.

Nozzles 70, 72, 74 are configured to produce a fine mist or spray of the material being applied thereby. In some embodiments, the material can be referred to as having been "atomized". A carrier, such as air or inert gas may be used; in some embodiments, a propellant may be used. The droplets of material, as applied by nozzles 70, 72, 74, are sufficiently small to cover platen surface 24, 44 without globules of adhesive or abrasive yet sufficiently large that a fog is not created. Individual nozzles 70, 72, 74 may produce different size droplets, and the droplets may be monodisperse or polydisperse. For example, it may be desired to have the abrasive slurry applied with larger droplets than the polymeric adhesive. Further, individual nozzles 70, 72, 74 may apply different coating weights of material.

System 60, having two adhesive spray applicators or nozzles 70, 72 is particularly suited for application of polymeric resins that have two parts, such as an epoxy which has an epoxide part and a hardener part. Other systems may utilize one spray applicator or nozzle for both parts.

As indicated above, abrasive particles 28, 50 are applied as a slurry, i.e., abrasive particles in a liquid (solvent) carrier. Preferably, no polymeric adhesive is present in the abrasive slurry; in some embodiments, however, a portion or part of the adhesive may be mixed with abrasive particles 28, 50 (e.g., the epoxide part may be mixed with abrasive particles 28, 50, but not the hardener part). Examples of suitable solvents for the abrasive slurry include water, alcohols (e.g., ethanol, methanol, isopropyl alcohol (IPA), etc.), glycols (e.g., propylene glycol DMA or glycol ether DMA, also referred to as di(propylene glycol) mono methyl ether). The solvent for the diamond slurry may be an emulsion of two or more solvents (either an oil-in-water or a water-in-oil), may be solution of two or more solvents, or may be a mixture of two or more solvents. The abrasive slurry may be a permanent suspension, where the abrasive (e.g., diamond) does not settle and does not need to be agitated (stirred) during the process, or the abrasive particles may settle in the solvent, depending on the size of the abrasive particles and the solvent used.

The abrasive particles in the abrasive slurry are generally no more than 10 micrometers, although in some embodiments larger particles may be used. If the resulting lapping plate 20, 40 is for a rough lapping step, abrasive particles 28, 50 have a size of about 1 to 5 micrometers, e.g., about 2-3 micrometers. If the resulting lapping plate 20, 40 is for a fine lapping step, abrasive particles 28, 50 have a size of about 0.1 to 1 micrometer, e.g., about 0.1 to 0.15 micrometer. For a kiss lapping step, abrasive particles 28, 50 have a size of less than 0.1 micrometer.

Abrasive particles 28, 50 (e.g., diamond) may be present in the abrasive slurry at a concentration of about 0.1 ctw to 50 ctw, which is 0.02 gram/ml to 10 grams/ml. In some embodiments, the abrasive particles are present at a concentration of 0.1 gram/ml to 5 grams/ml, or 1 gram/ml to 2 grams/ml.

The resulting abrasive coating has a thickness no greater than 10 micrometers, in some embodiments no greater than 8 micrometers, although in some embodiments a thicker abrasive coating may be obtained and/or desired. Exemplary coating thicknesses include no more than 2 micrometers and no more than 1.5 micrometers. In some embodiments, the abrasive particles form a monolayer and the abrasive coating thickness is defined by the thickness of the monolayer. Depending on the rate of application of the polymeric adhesive and the abrasive slurry, the adhesive may be thinner than the diameter of the abrasive particles, as illustrated in FIGS. 3 and 4. For example, adhesive 30, 52 may have a thickness of 1.5 micrometers with abrasive particles of 3 micrometers diameter protruding therefrom. In some embodiments, the thickness of adhesive 30, 52 is no more than 5 micrometers, in other embodiments no more than 4 micrometers. Spraying the adhesive and the abrasive particles, as per this disclosure, results in thin, uniform coatings of adhesive 30, 52 and abrasive particles 28, 50. Typically, abrasive particles 28, 50 protrude out from adhesive 30, 52. At least 20% of the height of abrasive particle 28, 50 protrudes out from adhesive 30, 52, and in most embodiments at least 35% of abrasive particle 28, 50 protrudes out from adhesive 30, 52, in some embodiments as much as 50% or 60%. Depending on the particular adhesive used and the surface characteristics of the abrasive particles, protrusion of as much as 70% or 80% may be possible.

In an example, an epoxy/diamond coating was applied to a lapping plate by the following procedure.

A textured lapping plate (12.9 inch OD, 8 inch ID, and 1.5 inch thick) having a spiral groove (pitch of 0.26 micrometers and depth of 10 micrometers) was made by knurling the groove into the lapping plate according to the teachings of U.S. application Ser. No. 13/716,456 (Moudry et al.) at a speed of 60 rpm and a feed rate 16 mm/min per pass. The grooved plate was washed and then planarized for 2 minutes on a LapMaster Model 15 lapping machine using an OSL truing disc and an aluminum oxide lapping film (40 micrometer $Al_2O_3$, "3M 266X Lapping Film") in the presence of Kerfaid lubricant, with the truing disc rotating at 15 rpm and the plate rotating at 10 rpm. After which the lapping plate was again washed.

2 ml of "Ultrathin 2" epoxy resin (from Pace Technologies), 0.4 mL of "Ultrathin 2" hardener (ULTRA-3000H-08), and 2 mL of Hyprez® diamond slurry (3 micrometer diamonds, 10 ctw, in isopropyl alcohol) were each individually and sequentially sprayed onto the washed lapping plate. The coated plate was placed into a convection oven set at 80° C. for 1 hour, after which the oven was turned off and allowed to cool.

The surface of the resulting lapping plate was measured with a Taylor Hobson Surtronics 3+ profilometer at three equally distant sites on the plate. The measurement showed that the abrasive surface had a roughness (Ra) between 5 micrometers and 10 micrometers.

It is understood that numerous variations of the lapping plates and methods of making the plates could be made while maintaining the overall inventive design and remaining within the scope of the disclosure. Numerous alternate design or element features have been mentioned above.

Thus, embodiments of the METHOD FOR FORMING AN ABRASIVE LAPPING PLATE are disclosed. The implementations described above and other implementations are within the scope of the following claims. One skilled in the art will appreciate that the present invention can be practiced with embodiments other than those disclosed. The disclosed embodiments are presented for purposes of illustration and not limitation, and the present invention is limited only by the claims that follow.

What is claimed is:

1. A method of forming an abrasive coating on a lapping plate, comprising:

(a) providing a lapping plate having a surface;

(b) spraying an adhesive onto the surface;

(c) spraying a slurry of abrasive particles and solvent onto the adhesive; and (d) curing the adhesive to form an abrasive coating having a thickness no more than 2 micrometers on the lapping plate.

2. The method of claim 1 wherein spraying the slurry comprises spraying a slurry of diamond particles and alcohol.

3. The method of claim 1 wherein spraying the slurry comprises spraying a slurry of diamond particles having an average particle size in the range of 0.1 to 5 micrometers.

4. The method of claim 1 wherein curing the adhesive to form an abrasive coating comprises curing the adhesive to form an abrasive coating with the abrasive particles protruding from the adhesive at least 35% of their height.

5. The method of claim 1 wherein spraying an adhesive onto the surface comprises spraying an epoxy adhesive onto the surface.

6. The method of claim 5 wherein spraying an epoxy adhesive comprises spraying a first epoxide part and a second hardener part.

7. The method of claim 1 wherein providing a lapping plate having a surface comprises providing a lapping plate having a surface with recessed portions.

8. A method of forming an abrasive coating on a lapping plate, comprising:

(a) providing a lapping plate having a surface;

(b) spraying a first part of an epoxy resin onto the surface with a first applicator;

(c) spraying a second part of the epoxy resin onto the surface with a second applicator;

(d) spraying a slurry of abrasive particles and solvent onto the surface; and (e) after spraying the first part, the second part and the slurry onto the surface, reacting the first part and the second part to form an abrasive coating on the lapping plate.

9. The method of claim 8 wherein spraying the first part and spraying the second part is done simultaneously.

10. The method of claim 8 wherein spraying the first part, spraying the second part, and spraying the slurry is done simultaneously.

11. The method of claim 8 wherein spraying the first part, spraying the second part, and spraying the slurry is done sequentially.

12. The method of claim 11 wherein spraying the slurry is done after spraying the first part and spraying the second part.

13. The method of claim 8 wherein spraying the slurry comprises spraying a slurry of diamond particles and alcohol.

14. The method of claim 8 wherein spraying the slurry comprises spraying a slurry of diamond particles having an average particle size in the range of 0.1 to 5 micrometers.

15. The method of claim 8 wherein reacting the first part and the second part to form an abrasive coating comprises reacting the first part and the second part to form an abrasive coating having a thickness of no more than 2 micrometers.

16. The method of claim 8 wherein providing a lapping plate having a surface comprising providing a lapping plate having a surface with recessed portions.

17. A method of forming an abrasive coating on a lapping plate, comprising:

(a) providing a lapping plate having a surface;

(b) spraying a first part of an adhesive onto the surface with a first applicator;

(c) spraying a second part of the adhesive onto the surface with a third applicator;

(d) spraying a slurry of abrasive particles and solvent onto the surface with a second applicator; and (e) after spraying the adhesive and the slurry onto the surface, reacting the adhesive to form an abrasive coating on the lapping plate.

18. The method of claim 17 wherein:

(i) spraying the first part of the adhesive comprises spraying a first part of an epoxy resin onto the surface with the first applicator; and (ii) spraying the second part of the adhesive comprises spraying a second part of the epoxy resin onto the surface with the third applicator.

19. The method of claim 17 wherein spraying the slurry comprises spraying a slurry of diamond particles and alcohol.

* * * * *